US007104423B2

(12) United States Patent
Smith

(10) Patent No.: US 7,104,423 B2
(45) Date of Patent: Sep. 12, 2006

(54) CONTAINER WITH FITMENT

(75) Inventor: Derek John Smith, Tillicoultry (GB)

(73) Assignee: G.R. Advanced Materials Limited, London (GB)

( * ) Notice: Subject to any disclaimer, the term of this patent is extended or adjusted under 35 U.S.C. 154(b) by 187 days.

(21) Appl. No.: 10/955,188

(22) Filed: Sep. 30, 2004

(65) Prior Publication Data

US 2005/0072797 A1 Apr. 7, 2005

(30) Foreign Application Priority Data

Oct. 1, 2003 (GB) ..... 0322986.1

(51) Int. Cl.
*B65D 35/56* (2006.01)

(52) U.S. Cl. ..... 222/105; 222/183

(58) Field of Classification Search ..... 222/105, 222/183, 107, 185.1, 95; 229/117.13, 117.14, 229/117.16, 117.35, 120.11, 120.18
See application file for complete search history.

(56) References Cited

U.S. PATENT DOCUMENTS 4,589,577 A * 5/1986 Welsh et al. ..... 222/518
4,850,506 A * 7/1989 Heaps et al. ..... 229/117.3
5,351,849 A 10/1994 Jagenburg et al.
5,377,876 A * 1/1995 Smernoff ..... 222/105
5,474,212 A * 12/1995 Ichikawa et al. ..... 222/105
5,497,899 A * 3/1996 Wuerfel ..... 229/117.13
5,562,227 A * 10/1996 Takezawa et al. ..... 229/117.13
5,579,953 A 12/1996 Perkins
5,826,752 A * 10/1998 Latimer ..... 222/105
6,131,767 A * 10/2000 Savage et al. ..... 222/1

FOREIGN PATENT DOCUMENTS

EP 0 365 841 A1 5/1990

* cited by examiner

*Primary Examiner*—Frederick C. Nicolas
(74) *Attorney, Agent, or Firm*—McNair Law Firm, PA; Cort Flint

(57) ABSTRACT

A container comprising a box made of compressible sheet material and a liquid-tight bag having a fitting to allow extraction of the contents of the bag, wherein: the fitting projects through an aperture in a wall of the box, the wall comprises at least two layers of said compressible sheet material and the fitting has a pair of flanges, one either side of the wall and spaced apart a distance smaller than the uncompressed thickness of said two layers of compressible sheet material.

14 Claims, 1 Drawing Sheet

CONTAINER WITH FITMENT

BACKGROUND OF THE INVENTION

The present invention relates to containers with built-in fittings to enable dispensing of the contents and more particularly to containers of the type comprising a cardboard box with an internal bag for containing a liquid.

Some digital copiers use emulsion inks which require protection after manufacture, during transportation and storage, and must be loaded into the printer without spillage. Containers of the "bag-in-box" type, which usually comprise a cardboard box containing a bag for the ink, have been used. The bag has a fitting to connect with the ink extraction nozzle of the digital duplicator. To ensure correct and easy attachment of the fitting to the ink extraction nozzle, the position and angular orientation of the fitting relative to the nozzle is critical.

It would be desirable to provide a container in which the position and orientation of the fitting can be assured, even after transportation and storage.

SUMMARY OF THE INVENTION

Accordingly, the present invention provides a container comprising a box made of compressible sheet material and a liquid-tight bag having a fitting to allow extraction of the contents of the bag. The fitting projects through an aperture in a wall of the box, and the wall comprises at least two layers of compressible sheet material. The fitting has a pair of flanges, one either side of the wall and spaced apart a distance smaller than the uncompressed thickness of the two layers of compressible sheet material.

By ensuring the fitting engages with two layers of compressible material forming a wall of the box and that these two layers are compressed by flanges of the fitting, the stability of the position of the fitting can be ensured, even after a degree of rough handling in transportation and storage. This enables easy and reliable connection of the fitting to an extraction nozzle of an apparatus, such as a digital duplicator, in which the contents of the container are to be used.

Preferably, the fitting is generally rectangular, most preferably square, in cross-section, at least in the part thereof that passes through said wall, and the aperture in the wall of the box has a corresponding shape. This ensures consistent orientation of the bag within the box and prevents rotation of the fitting and bag during application and removal of a cap on the fitting.

In a preferred embodiment of the invention, the two layers of material through which the fitting passes comprise a wall member and a flap depending from a lid which closes the box. In this embodiment, the aperture is preferably formed by slots cut into the wall and the flap. Most preferably, the wall member is generally perpendicular to the hinge about which the lid rotates to close the box and the cutout in the flap is arcuate. With the arrangement, the flap is forced around the fitting as the lid of the box is closed and the force generated by the compression of the two layers of material between the flanges of the fitting pins the flap, wall member and fitting together, both ensuring the correct position and orientation of the fitting and holding the lid closed.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

Figure 1:
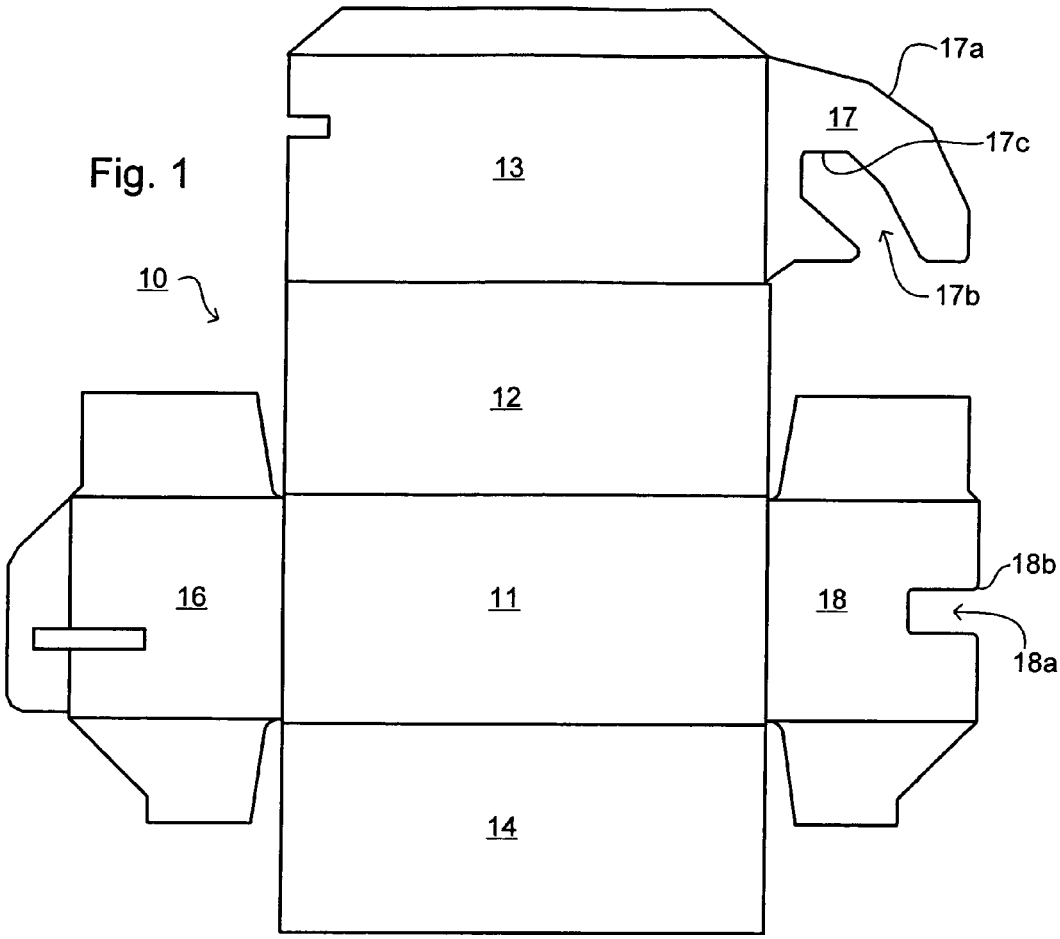
Figure 2:
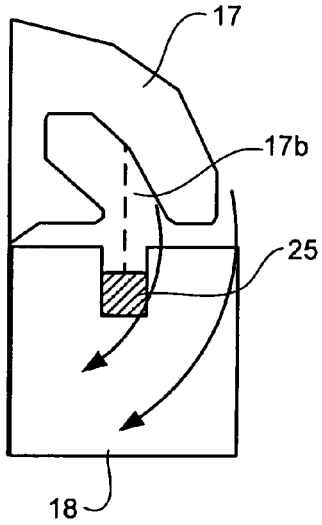
Figure 3:
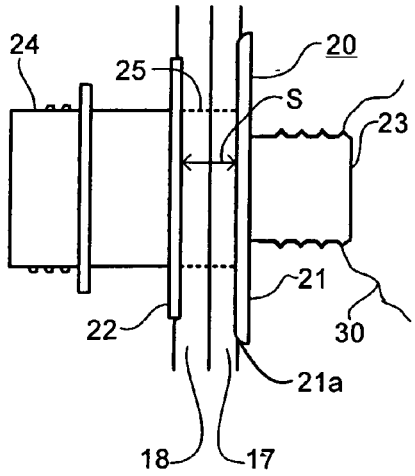

An exemplary embodiment of the present invention will be described below with reference to the accompanying schematic drawings, in which:

FIG. 1 is a plan view of a blank which is folded to form the box of an embodiment of the invention;

FIG. 2 is a side view showing how the box of the embodiment of FIG. 1 is closed; and FIG. 3 is a side view of the fitting engaged in the wall of the box of the embodiment of FIG. 1.

In the various drawings, like parts are denoted by like references.

DESCRIPTION OF A PREFERRED EMBODIMENT

A preferred embodiment of the invention comprises a generally cuboid, elongate cardboard box, which is folded from the blank 10 illustrated in FIG. 1, containing a fluid-tight bag 30 and a fitting 20 that projects through and is anchored by a wall of the box to allow extraction of the contents of the bag. Blank 10 is preferably cut from a single piece of corrugated cardboard of appropriate weight, or other suitable compressible material.

To make up the box, the blank 10 is folded so that the generally rectangular major faces 11, 12 and 14 together with end walls 16 and 18 form an open box that is closed by lid 13. Lid 13 is hinged to major face 12 along a long side.

To secure the fitting 20, a rectangular slot 18*a*, matching the cross-section of the fitting 20 where it passes through the wall of the box, is cut into the free edge of end wall 18. The corners 18*b* of the slot 18*a* are radiused to ease insertion of the fitting 20 when the bag is placed in the box. The flap 17 has a generally curved edge 17*a* and an arcuate slot 17*b* cut in from the remaining free edge so that as the lid 13 is hinged to close the box the slot engages around the fitting 20, as shown in FIG. 2. The end 17*c* of the arcuate slot 17*b* is square to match the cross-section of the fitting where it passes through the wall of the box. The end result is that the fitting is held closely on all four sides by the matching ends of the slots 18*a* nd 17*b*, securing its position firmly.

FIG. 3 shows the side of the fitting 20 which is a one-piece plastic moulding. One end 23 of the fitting 20 is generally cylindrical and is sealed to the bag 30, which may be made of a plasticised foil capable of containing the liquid, e.g. emulsion ink, for which the container is intended. The other end 24 is designed to connect to an extraction nozzle, e.g. on a digital duplicator, and may be partly threaded to accommodate a threaded cap for closure.

The central 25 part of the fitting 20 is square in cross-section, to match the shape of the ends of the slots 17*b*, 18*a*, and has two flanges 21, 22. The flanges 21, 22 pinch between them the two layers of cardboard (end wall 18 and flap 17) through which the fitting projects and their separation S is slightly less than twice the thickness of the cardboard making up blank 10 so that the cardboard is compressed when the fitting is installed and the box closed. The resulting force pins the fitting in place and holds the flap 17 so that the lid 13 is held closed. It also maintains the fitting perpendicular to the end wall 18. To ease insertion of the flap 17 as the lid 13 is closed, the inside edge 21*a* of flange 21 is radiused.

Whilst a specific embodiment of the invention has been described, it will be appreciated that the foregoing description is intended to be descriptive rather than prescriptive and that the invention is defined by the appended claims.

What is claimed is:

1. A dispensing container comprising:

a box made of compressible sheet material;

an aperture formed in a wall of said box;

a liquid-tight bag;

a fitting in communication with said liquid-tight bag extending through said aperture of said wall to allow extraction of the contents of the bag;

said wall including at least two layers of said compressible sheet material; and said fitting having a pair of flanges between which said wall is sandwiched, and said flanges being spaced apart a distance smaller than an uncompressed thickness of said two layers of compressible sheet material.

2. A container according to claim 1 wherein the fitting is generally rectangular, most preferably square, in cross-section at least in the part thereof that passes through said wall and the aperture in the wall of the box has a corresponding shape.

3. A container according to claim 1 wherein the two layers through which the fitting passes comprise a wall member and a flap depending from a lid which closes the box.

4. A container according to claim 3 wherein the aperture is formed by slots cut into the wall and the flap.

5. A container according to claim 4 wherein the wall member is generally perpendicular to the hinge about which the lid rotates to close the box and the cutout in the flap is arcuate.

6. A container according to claim 1 wherein the box is made of cardboard, preferably corrugated cardboard.

7. A container according to claim 1 wherein the bag contains an emulsion ink.

8. A liquid dispensing container comprising a box having a wall, an aperture formed in said wall of said box, a liquid-tight bag, and a fitting in communication with said liquid-tight bag extending through said aperture of said wall to allow extraction of the contents of the bag; wherein said container comprises:

a compressible wall made from a compressible material;

said aperture formed in said compressible material of said wall; and said fitting received in said aperture having a pair of flanges between which said wall is sandwiched, and said flanges being spaced apart a distance smaller than an uncompressed thickness of said compressible material.

9. A container according to claim 8 wherein the fitting is generally rectangular, most preferably square, in cross-section at least in the part thereof that passes through said wall and the aperture in the wall of the box has a corresponding shape.

10. A container according to claim 9 wherein said compressible wall includes two layers of compressible material through which the fitting passes and a flap depending from a lid which closes the box.

11. A container according to claim 10 wherein the aperture is formed by slots cut into the wall and the flap.

12. A container according to claim 11 wherein the wall member is generally perpendicular to the hinge about which the lid rotates to close the box and the cutout in the flap is arcuate.

13. A container according to claim 8 wherein the box is made of cardboard, preferably corrugated cardboard.

14. A container according to claim 8 wherein the bag contains an emulsion ink.

* * * * *